US012529277B2

(12) United States Patent
Alharith

(10) Patent No.: US 12,529,277 B2
(45) Date of Patent: Jan. 20, 2026

(54) HYBRID MILLING HIGH POWER LASER TOOL

(71) Applicant: SAUDI ARABIAN OIL COMPANY, Dhahran (SA)

(72) Inventor: Abdullah M. Alharith, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 245 days.

(21) Appl. No.: 18/355,262

(22) Filed: Jul. 19, 2023

(65) Prior Publication Data

US 2025/0027371 A1 Jan. 23, 2025

(51) Int. Cl.
*E21B 29/02* (2006.01)
*E21B 7/15* (2006.01)
*E21B 29/00* (2006.01)

(52) U.S. Cl.
CPC ..... *E21B 29/02* (2013.01); *E21B 7/15* (2013.01); *E21B 29/002* (2013.01)

(58) Field of Classification Search
CPC ..... E21B 7/15; E21B 29/005; E21B 29/02; E21B 29/002
See application file for complete search history.

(56) References Cited

U.S. PATENT DOCUMENTS 2,695,673 A * 11/1954 Coyle ..... E21B 37/02 166/170
3,827,492 A * 8/1974 Hammon ..... E21B 37/02 166/173
5,014,778 A * 5/1991 Lynde ..... E21B 29/002 166/55.6
5,074,355 A 12/1991 Lennon
5,899,268 A 5/1999 Lynde et al.
10,883,359 B2 * 1/2021 Stokes ..... E21B 33/134
11,220,876 B1 1/2022 Al Obaid
11,821,276 B2 * 11/2023 Batarseh ..... B23K 26/0876
11,913,303 B2 * 2/2024 Batarseh ..... E21B 41/0078
12,098,635 B2 * 9/2024 Batarseh ..... E21B 7/14
2003/0029644 A1 * 2/2003 Hoffmaster ..... E21B 10/55 175/263
2004/0134687 A1 * 7/2004 Radford ..... E21B 17/1014 175/57
2013/0228372 A1 * 9/2013 Linyaev ..... E21B 43/26 175/16
2018/0245450 A1 * 8/2018 Stokes ..... E21B 33/134
2018/0258735 A1 * 9/2018 Shafer ..... E21B 29/002
2019/0032434 A1 * 1/2019 Batarseh ..... G02B 27/0994
2020/0048966 A1 * 2/2020 Batarseh ..... E21B 7/15
(Continued)

FOREIGN PATENT DOCUMENTS

CN 114961571 A * 8/2022
WO 2015/088553 A1 6/2015
WO 2022/038405 A1 2/2022

*Primary Examiner* — Jennifer H Gay
(74) *Attorney, Agent, or Firm* — Osha Bergman Watanabe & Burton LLP

(57) ABSTRACT

A downhole tool includes a milling rotary body, a fiber optic cable extending through the milling rotary body, one or more milling knives extending outwardly from the milling rotary body at an end of the milling rotary body, and a laser head extending from the second end of the milling rotary body. The fiber optic cable is connected to the laser head, and the laser head is configured to rotate about a central axis of the milling rotary body.

18 Claims, 4 Drawing Sheets

(56) References Cited

U.S. PATENT DOCUMENTS

| | | | | |
|---|---|---|---|---|
| 2020/0115962 | A1* | 4/2020 | Batarseh | E21B 41/0078 |
| 2021/0079747 | A1* | 3/2021 | Grindhaug | E21B 23/0415 |
| 2021/0162545 | A1 | 6/2021 | Faircloth et al. | |
| 2021/0372252 | A1* | 12/2021 | Batarseh | E21B 43/26 |
| 2021/0387269 | A1* | 12/2021 | Mcallister | E21B 23/01 |
| 2022/0105592 | A1 | 4/2022 | Zediker et al. | |
| 2023/0151707 | A1* | 5/2023 | Batarseh | E21B 47/09 166/255.2 |
| 2023/0407707 | A1* | 12/2023 | Batarseh | E21B 7/14 |
| 2023/0407724 | A1* | 12/2023 | Batarseh | E21B 41/0078 |
| 2025/0027371 | A1* | 1/2025 | Alharith | E21B 29/005 |

* cited by examiner

HYBRID MILLING HIGH POWER LASER TOOL

BACKGROUND

Section milling over a given length of a well casing is essential in plug and abandonment operations, which may require the removal of casing in order to isolate the wellbore with cement. Casings, which are generally composed of steel, generally damage or dull conventional milling tools due to excessive friction. As a result, milling equipment requires frequent replacement in order to complete casing removal. Further, conventional milling tools typically have a low rate of penetration, which results in a costly milling process.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to hybrid-milling tools that include a milling rotary body, which may be connected to a toolstring at a first end of the milling rotary body (e.g., via a threaded connection). One or more milling knives may extend outwardly from the milling rotary body at a second end of the milling rotary body, opposite the first end. A laser head may extend axially from the second end of the milling rotary body, wherein the laser head is configured to rotate about a central axis of the milling rotary body. A fiber optic cable may extend through the milling rotary body, wherein the fiber optic cable is connected to the laser head.

In another aspect, embodiments disclosed herein relate to methods for cutting through a casing wall in a well using hybrid-milling tools according to embodiments disclosed herein. Such methods may include lowering the hybrid-milling tool on a toolstring to a target section of a casing wall in a wellbore of a well, generating a laser beam from a laser power generator, directing the laser beam from the laser power generator, through a fiber optic cable, to the laser head of the hybrid-milling tool, and emitting the laser beam from the laser head at a first laser power. The laser head may be rotated about a central axis of the hybrid-milling tool while the laser beam is emitted from the laser head to create a helical groove in the casing wall with the laser beam in the target section. After at least a portion of the helical groove is created in the target section, milling knives on the hybrid-milling tool are used to cut through the target section of the casing wall.

In yet another aspect, embodiments disclosed herein relate to systems that include a toolstring lowered into a wellbore of a well and a hybrid-milling tool secured to a first end of the toolstring. The hybrid-milling tool includes a milling rotary body extending from the toolstring at the first end, one or more milling knives extending outwardly from the milling rotary body at a second end of the milling rotary body, and a laser head extending from the second end of the milling rotary body. A fiber optic cable may extend along the toolstring and through the milling rotary body to the laser head.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
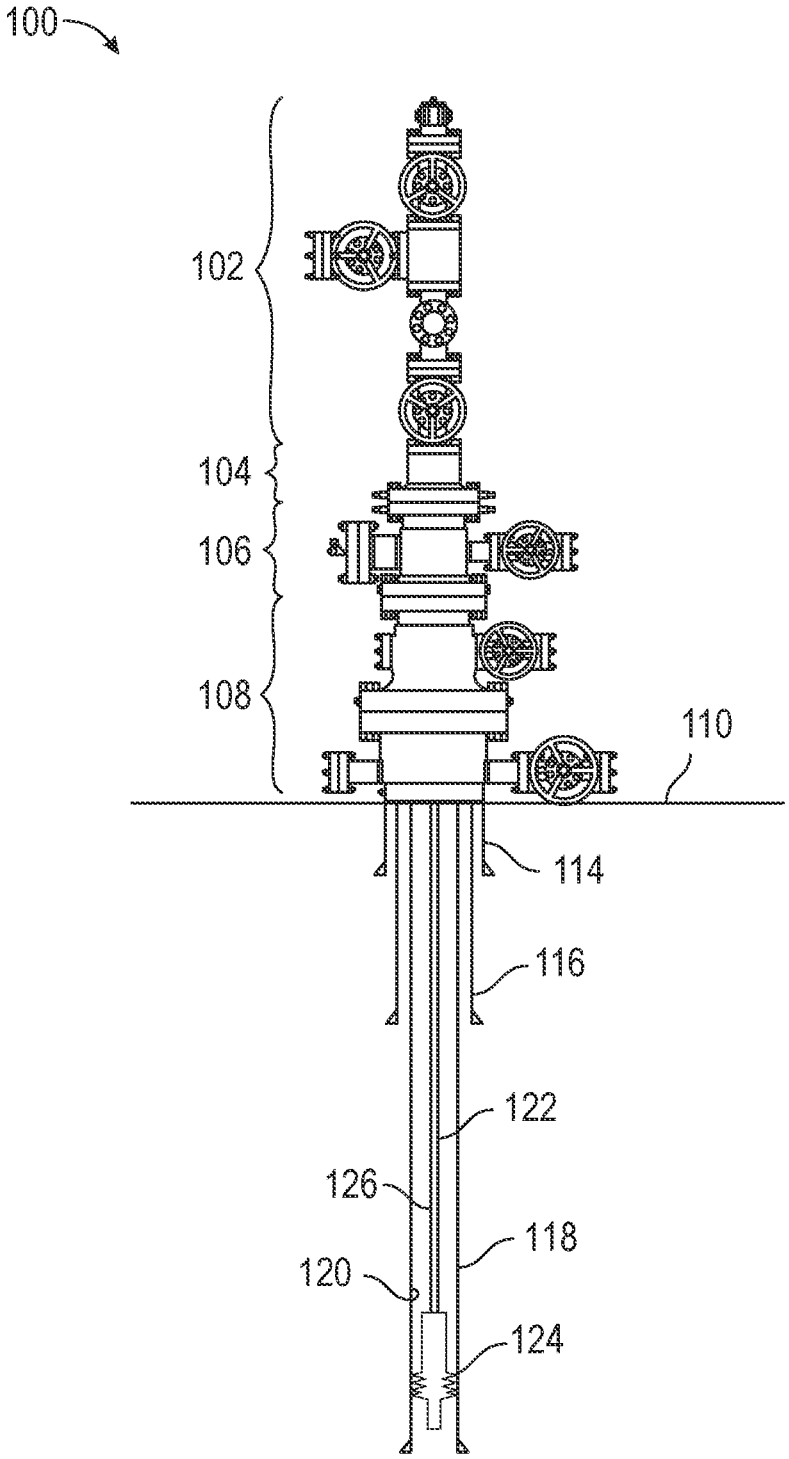
FIG. 1 shows an exemplary well.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "a fracture" includes reference to one or more of such fractures.

In the following description of FIGS. 1-5, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

In one aspect, embodiments disclosed herein relate to a hybrid-milling tool comprising one or more milling knives and a laser head. More specifically, the hybrid-milling tool may be configured to create a helical groove in a casing wall using a laser beam emitted from the laser head, weakening the integrity of the casing wall. The one or more milling knives may then be used to cut through the weakened casing wall. In another aspect, embodiments disclosed herein relate to a downhole tool, which may include a hybrid-milling tool secured to a toolstring, where the downhole tool may be lowered into a wellbore until it reaches a target section of a casing within the wellbore. In yet another aspect, embodiments disclosed herein relate to operating a downhole tool, which may include a hybrid-milling tool secured to a toolstring, in a target section of a casing within a wellbore.

FIG. 1 shows an exemplary well 100 in which a hybrid-milling tool in accordance with one or more embodiments is used to mill a casing wall. The well 100 includes a production tree 102, a tubing bonnet 104, a tubing head 106, and a casing head 108 located on a surface location 110 that may be located anywhere on the Earth's surface. The production tree 102 has a plurality of valves that control the production of production fluids that come from a production zone located beneath the surface location 110. The valves also allow for access to the subsurface portion of the well 100.

The well 100 has three strings of casing: conductor casing 114, surface casing 116, and production casing 118. The casing strings are made of a plurality of long high-diameter tubulars threaded together. The tubulars may be made out of any durable material known in the art, such as steel. The casing strings 114, 116, 118 are cemented in place within the well 100. Casing strings may be fully or partially cemented in place without departing from the scope of the disclosure herein.

Each string of casing, starting with the conductor casing 114 and ending with the production casing 118, decreases in both outer diameter and inner diameter such that the surface casing 116 is nested within the conductor casing 114 and the production casing 118 is nested within the surface casing 116. Upon completion of the well 100, the inner circumferential surface 120 of the production casing 118 and the space located within the production casing 118, make up the interior of the well 100.

The majority of the length of the conductor casing 114, surface casing 116, and production casing 118 are located underground. However, the surface-extending portion of each casing string is housed in the casing head 108, also known as a wellhead, located at the surface location 110. The surface-extending portion of each casing string may include a casing hanger (not pictured) that is specially machined to be set and hung within the casing head 108. There may be multiple casing heads 108 depending on the number of casing strings without departing from the scope of the disclosure herein.

During production of the well, production tubing may be deployed within the production casing 118. The production tubing may include a plurality of tubulars connected together and may be interspersed with various pieces of equipment such as artificial lift equipment, packers, etc. When deployed, the majority of the length of the production tubing is located in the interior of the well 100 underground. However, the surface-extending portion of the production tubing is housed in the tubing head 106 which is installed on top of the casing head 108. The surface-extending portion of the production tubing may include a tubing hanger (not pictured) that is specially machined to be set and hung within the tubing head 106. The production tree 102 is connected to the top of the tubing head 106 using the tubing bonnet 104. The tubing bonnet 104 is an adapter comprising one or more seals (not pictured).

In accordance with one or more embodiments, the production casing 118 may comprise a portion made of slotted casing or screen such that production fluids may flow into the production casing 118 from the formation. In other embodiments, the production casing 118 may include perforations made through the production casing 118, cement, and wellbore in order to provide a pathway for production fluids to flow from the production zone of the surrounding formation into the interior of the well 100.

Production fluids may travel from the interior of the well 100 to the surface location 110 through the production tubing. A pipeline (not pictured) may be connected to the production tree 102 to transport the production fluids away from the well 100. The well 100 depicted in FIG. 1 is one example of a well 100 but is not meant to be limiting. The scope of this disclosure encompasses any well 100 design that has at least one string of casing in the well 100. Further, the well 100 may have other variations of surface equipment without departing from the scope of this disclosure.

Plug and abandonment operations are typically executed to prepare a well, such as well 100, to be closed permanently. A well 100 may be closed permanently if logs have determined that production operations have drained the reservoir, for example. Plug and abandonment operations may include removing casing from the well 100 in order to isolate the wellbore with cement. Embodiments disclosed herein relate to a downhole milling tool for use in casing removal in preparation for plug and abandonment operations.

In one or more methods according to embodiments of the present disclosure, a section of casing may be removed from a well 100, for example, for plug and abandonment operations or other purpose. In one or more embodiments, the well 100 may be prepared for casing removal by removing any production tubing deployed in the well. A hybrid-milling tool 124 in accordance with one or more embodiments of the present disclosure may then be sent down the well 100 to a downhole location. For example, the hybrid-milling tool 124 may be deployed into the well 100 via a toolstring 126. The hybrid-milling tool 124 may then be rotated and operated using surface equipment to cut the casing (e.g., production casing 118), as described in more detail below.

Figure 2:
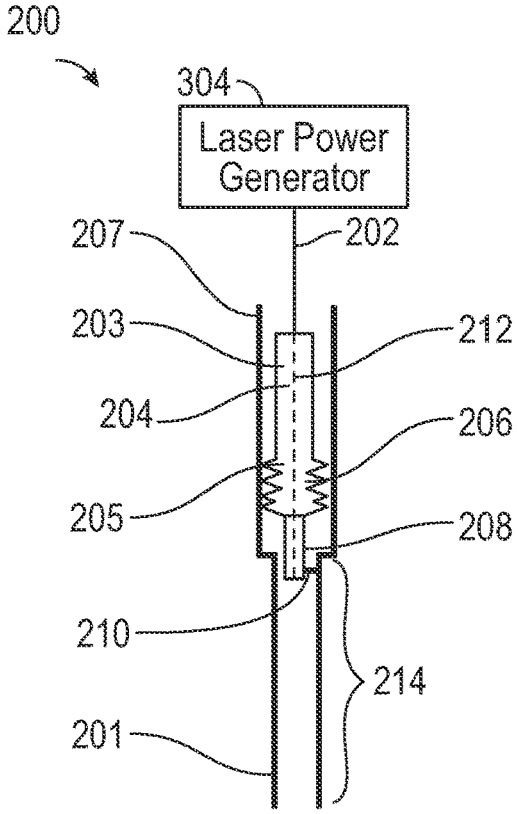
FIG. 2 shows a hybrid-milling tool in accordance with one or more embodiments.

Turning now to FIG. 2, FIG. 2 shows a hybrid-milling tool 200 in accordance with one or more embodiments. In one or more embodiments, the hybrid-milling tool 200 may be attached to a toolstring (not pictured), such as a wireline or slickline, and lowered down into the casing 201 to a desired depth, where the casing 201 may be cemented into a wellbore extending from the surface to a downhole reservoir. The casing 201 may be, for example, the conductor casing 114, surface casing 116, or production casing 118 shown in FIG. 1.

A fiber optic cable 202 may be coupled to the toolstring and may extend through a milling rotary body 204 from a first end 203 of the milling rotary body 204. For example, a fiber optic cable may be run through (within) a coiled tubing to a connected hybrid-milling tool to deliver a high power laser. The milling rotary body 204 may be coupled to the toolstring, e.g., via a threaded connection.

Figure 5:
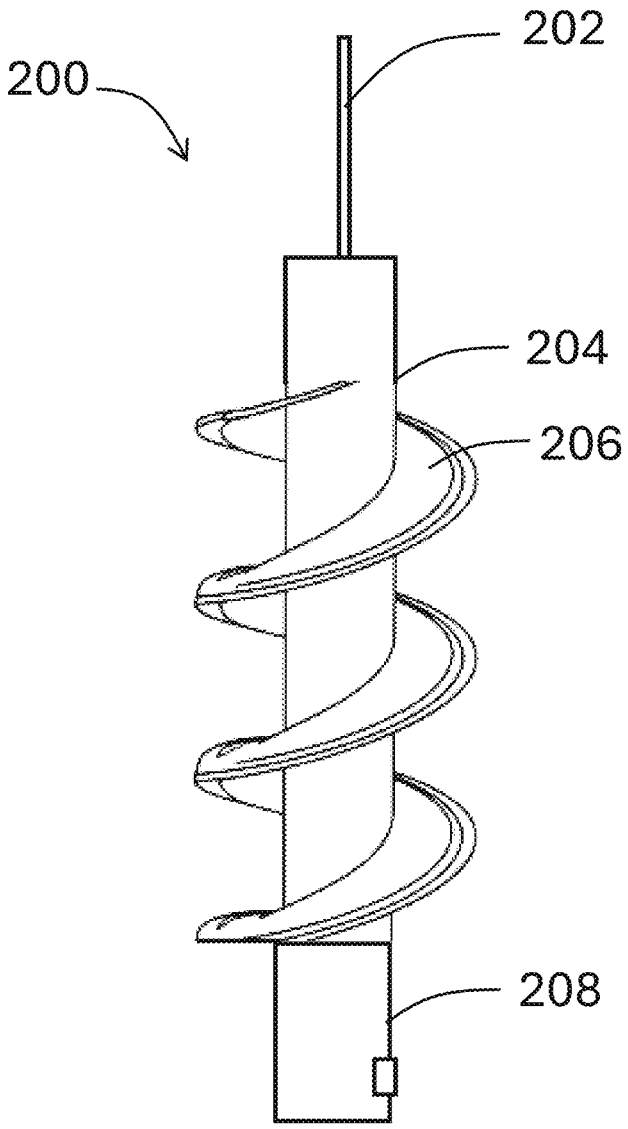
FIG. 5 shows a hybrid-milling tool in accordance with one or more embodiments.

One or more milling knives 206 may extend circumferentially around the milling rotary body 204 at a second end 205 of the milling rotary body 204. The milling knives 206 may extend radially outward from the milling rotary body 204 a distance capable of contacting the casing 201, such that as the milling knives rotate with the milling rotary body 204 about a central axis 212, the milling knives may contact and cut around the inner surface of the casing 201 wall. In some embodiments, the milling knives may extend radially outward from the milling rotary body in a linear or helical pattern along a length of the milling rotary body. For example, FIG. 5 shows an example of a hybrid-milling tool 200 with a laser head 208 at an end of the milling rotary body 204 opposite the connection end, a milling knife 206 between the laser head 208 and the connection end, and a fiber optic cable 202 extending through the body, where the milling knife 206 extends in a helical pattern circumferentially around the body and along a length of the milling rotary body 204. In some embodiments, the milling knives may have an abrasive outer cutting surface.

A laser head 208 may extend from the second end of the milling rotary body 204, opposite the connection end to the toolstring. The laser head 208 may be configured to rotate about the central axis 212 of the milling rotary body 204.

In one or more embodiments, the laser head 208 may be configured to emit a laser beam 210 in a direction outwardly from the tool's central axis 212, directed towards the casing 201 wall. For example, as shown in FIG. 2, the laser head 208 may extend a distance from the second end of the milling rotary body 204, where a laser outlet (through which the laser beam 210 is emitted) may be provided at an axial end of the laser head 208 and oriented at a side of the laser head 208. With such configuration, the laser outlet may direct the laser beam 210 in an outward direction from the tool's central axis 212 and at an axial distance apart from the milling knives 206. Such axial separation between the milling knives 206 and the laser beam 210 may allow for increased weakening of the casing wall by the laser beam 210 prior to cutting with the milling knives.

In one or more embodiments, the hybrid-milling tool 200 may be lowered into the wellbore 207 until a target section 214 of the casing 201 is reached. The target section 214 may refer to a section of casing 201 which is to be removed, e.g., for appropriate plug and abandonment operations.

Figure 3:
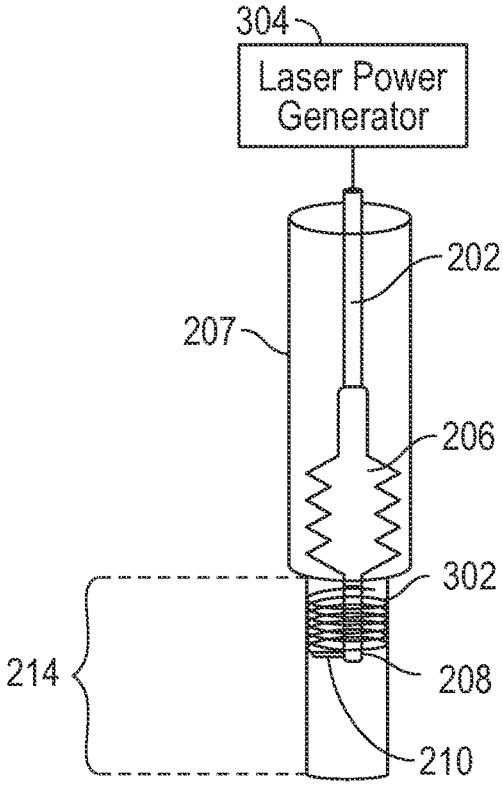
FIG. 3 shows a hybrid-milling tool in accordance with one or more embodiments.

Turning now to FIG. 3, FIG. 3 shows a hybrid-milling tool 200 in operation in accordance with one or more embodiments. Once the hybrid-milling tool 200 has been lowered into the wellbore 207 until the laser head 208 reaches the target section 214, the laser head 208 may be activated. In one or more embodiments, the laser head 208 may be powered by a laser power generator 304. The laser power generator 304 may be located at a surface location around the well (e.g., surface location 110). The fiber optic cable 202 may transmit the laser beam 210 from the laser power generator 304 to the laser head 208, from which it may be emitted.

The laser power generator 304 can be controlled at the surface to direct a laser through a fiber optic cable 202 to the laser head 208 of the hybrid-milling tool 200. The power of the laser power generator 304 may be altered to change the intensity of the emitted laser beam according to the needs of the job, e.g., casing material and thickness.

Once the laser head 208 has reached the target section 214, the laser beam 210 may be emitted, such that it is directed towards the casing 201 wall. As the laser beam 210 contacts the casing wall, the laser beam 210 may then begin to create a groove 302 in the casing 201 wall. In one or more embodiments, a groove 302 may refer to a partial cut, weakening, or damage of the casing 201. The laser head 208 may be rotated about the central axis 212 of the milling rotary body 204 as the laser beam 210 is emitted from the laser head to create a helical groove 302 in the casing 201 wall in the target section 214 as the hybrid-milling tool 200 continues to lower further into the wellbore 207. In one or more embodiments, the helical groove 302 may weaken the integrity of the casing 201 wall. The one or more milling knives 206, following the laser head 208 as the tool is continued to be lowered through the well, may then be used to cut through the casing 201 wall. The introduction of a helical groove 302 into the casing 201 wall prior to cutting with the one or more milling knives 206 may ease the milling process and increase the rate of penetration.

Figure 4:
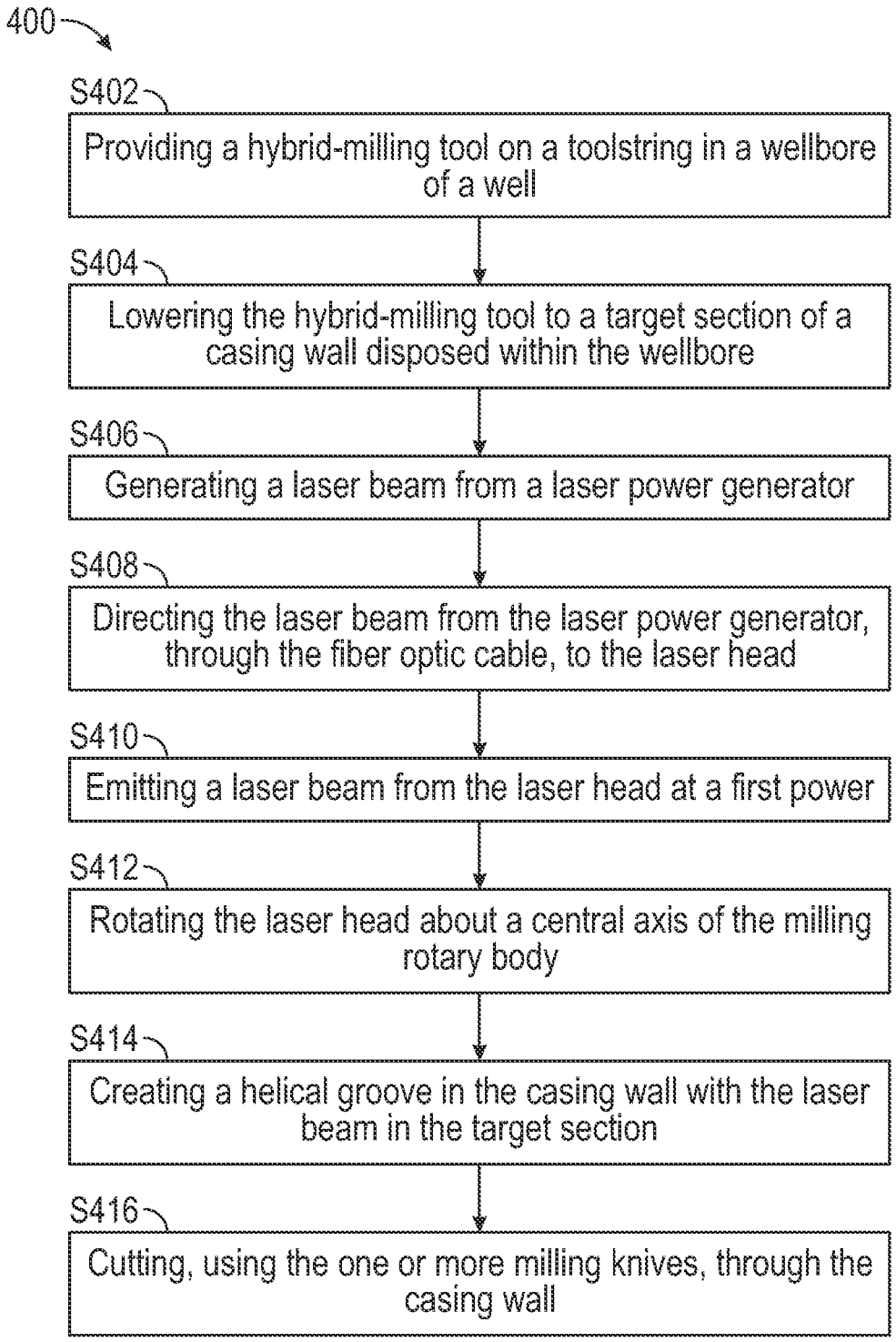
FIG. 4 shows a flowchart of a method in accordance with one or more embodiments.

FIG. 4 depicts a flowchart in accordance with one or more embodiments. More specifically, FIG. 4 depicts a flowchart 400 of a method for utilizing a packer protection system within a wellbore. Further, one or more blocks in FIG. 4 may be performed by one or more components as described in FIGS. 1-3 and 5. While the various blocks in FIG. 4 are presented and described sequentially, one of ordinary skill in the art will appreciate that one or more of the steps shown in the flowchart may be omitted, repeated, executed in parallel, and/or performed in a different order than the order shown. Furthermore, the blocks may be performed actively or passively.

Initially, a hybrid-milling tool 200 may be provided on a toolstring in a wellbore 207 of a well 100, S402. The hybrid-milling tool 200 may include a fiber optic cable 202, a milling rotary body 204, one or more milling knives 206 and a laser head 208. The hybrid-milling tool 200 may be lowered to a target section 214 of the casing 201 wall disposed within the wellbore 207, S404.

A laser beam 210 may be generated from a laser power generator 304, S406. Further, the laser beam 210 may be directed from the laser power generator 304 to the laser head 208 through the fiber optic cable 202, S408. The laser beam 210 may then be emitted from the laser head 208 at the first power, S410. the laser beam 210 may be directed towards the casing 201 wall. In one or more embodiments, a thickness of the casing 201 wall may be determined, and the first laser power may be selected based, at least in part, on the thickness of the casing 201 wall. In some embodiments, the thickness of the casing 201 wall and supporting cement, if any, may change. In such embodiments, the change in thickness may be detected and a second laser power may be selected based, at least in part, on the change in thickness. The laser beam 210 may then be generated by the laser power generator 304 at a second power.

The laser head 208 may be rotated about a central axis 212 of the milling rotary body 204, S412. For example, the laser head may be rotated with the entire hybrid-milling tool from surface tools (e.g., using a rotary table at the surface to rotate the toolstring on which the hybrid-milling tool is connected). In other embodiments, a laser head may be rotated electrically downhole. As the laser head 208 rotates, the laser beam 210 may create a helical groove 302 in the casing 201 wall in the target section 214, S414. The helical groove 302, in accordance with one or more embodiments, may extend in length as the hybrid-milling tool 200 is lowered further down the wellbore 207. In one or more embodiments, the helical groove 302 may weaken the integrity of the target section 214 of the casing 201 wall. The one or more milling knives 206 may then cut through the casing 201 wall, S416.

Embodiments of the present disclosure may provide at least one of the following advantages. Milling of steel casings or tubulars generally creates an excess of friction, which may lead to dulling of milling tools. As such, conventional milling procedures typically result in lower rates of penetrations and a shorter lifetime of milling tools. Embodiments of the present disclosure relate to a hybrid-milling tool which combines a laser beam and one or more milling knives to first weaken the integrity of a casing prior to cutting the casing. By weakening the casing prior to attempting to cut the casing, embodiments of the present disclosure ease the milling process, increase the rate of penetration, and extend the lifetime of milling tools.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. Although multiple dependent claims are not introduced, it would be apparent to one of ordinary skill that the subject matter of the dependent claims of one or more embodiments may be combined with other dependent claims.

What is claimed:

1. A hybrid-milling tool, comprising:
- a milling rotary body extending from a toolstring at a first end;
- a fiber optic cable extending through the milling rotary body;
- one or more milling knives fixed to and extending outwardly from the milling rotary body at a second end of the milling rotary body, opposite the first end; and
- a laser head extending from the second end of the milling rotary body,
- wherein the fiber optic cable is connected to the laser head, and
- wherein the laser head is configured to rotate about a central axis of the milling rotary body.

2. The hybrid-milling tool of claim 1, wherein the laser head is configured to emit a laser beam directed in a radially outward direction from the central axis.

3. The hybrid-milling tool of claim 1, wherein the one or more milling knives is a single milling knife that extends circumferentially around the milling rotary body and helically along a length of the milling rotary body.

4. The hybrid-milling tool of claim 1, wherein the laser head is powered by a laser generator located at a surface location.

5. The hybrid-milling tool of claim 1, wherein the laser head comprises a laser outlet positioned an axial distance from the one or more milling knives.

6. The hybrid-milling tool of claim 1, wherein the laser head is configured to create a partial cut in a target section of a casing wall, thereby forming a weakened casing wall.

7. The hybrid-milling tool of claim 6, wherein the one or more milling knives is configured to cut through the weakened casing wall.

8. A method, comprising:
- providing a hybrid-milling tool on a toolstring in a well, wherein the hybrid-milling tool comprises:
  - a milling rotary body extending from the toolstring at a first end;
  - a fiber optic cable extending through the milling rotary body;
  - one or more milling knives extending outwardly from the milling rotary body at a second end of the milling rotary body; and
  - a laser head extending from the milling rotary body;
- lowering the hybrid-milling tool to a target section of a casing wall disposed within the well;
- generating a laser beam from a laser power generator;
- directing the laser beam from the laser power generator, through the fiber optic cable, to the laser head;
- emitting the laser beam from the laser head at a first laser power;
- rotating the laser head about a central axis of the milling rotary body;
- creating a partial cut in the form of a helical groove in the casing wall with the laser beam in the target section, thereby forming a weakened casing wall; and
- cutting, using the one or more milling knives, through the weakened casing wall.

9. The method of claim 8, wherein the laser head is rotated with the milling rotary body.

10. The method of claim 9, wherein the hybrid-milling tool is rotated by rotating the toolstring using surface equipment of the well.

11. The method of claim 8, wherein the hybrid-milling tool is rotated about the central axis to rotate the one or more milling knives as the one or more milling knives cut the casing wall.

12. The method of claim 8, further comprising continuously lowering the hybrid-milling tool into the well and lengthening the helical groove in the casing wall.

13. The method of claim 8, further comprising:
- determining a thickness of the casing wall; and
- selecting the first laser power based, at least in part, on the thickness of the casing wall.

14. The method of claim 13, further comprising:
- detecting a change in the thickness of the casing wall;
- selecting a second laser power based, at least in part, on the change in the thickness of the casing wall; and
- generating the laser beam by the laser power generator at the second laser power.

15. A system, comprising:
- a toolstring lowered into a well having a casing wall;
- a hybrid-milling tool secured to a first end of the toolstring, where the hybrid-milling tool comprises:
  - a milling rotary body extending from the toolstring at the first end;
  - one or more milling knives extending outwardly from the milling rotary body at a second end of the milling rotary body; and
  - a laser head extending from the second end of the milling rotary body; and
- a fiber optic cable extending along the toolstring and through the milling rotary body to the laser head,
- wherein the laser head is configured to create a partial cut in a target section of the casing wall, thereby forming a weakened casing wall, and
- wherein the one or more milling knives is configured to cut through the weakened casing wall.

16. The system of claim 15, wherein the laser head comprises a laser outlet oriented to direct a laser beam in an outwardly direction from a central axis of the hybrid-milling tool.

17. The system of claim 15, wherein the one or milling knives is a single milling knife that extends circumferentially around the milling rotary body and helically along a length of the milling rotary body.

18. The system of claim 15, wherein the laser head is powered by a laser generator located at a surface location of the well.

* * * * *